US009016738B2

(12) United States Patent
Smith

(10) Patent No.: US 9,016,738 B2
(45) Date of Patent: Apr. 28, 2015

(54) APPARATUS AND METHOD FOR LIFTING A SKIMMER WELL LID AND FOR CLEANING AND LIFTING A SKIMMER BASKET

(71) Applicant: David Ray Smith, Baytown, TX (US)

(72) Inventor: David Ray Smith, Baytown, TX (US)

( * ) Notice: Subject to any disclaimer, the term of this patent is extended or adjusted under 35 U.S.C. 154(b) by 0 days.

(21) Appl. No.: 13/987,145

(22) Filed: Jul. 2, 2013

(65) Prior Publication Data

US 2014/0015267 A1 Jan. 16, 2014

Related U.S. Application Data

(60) Provisional application No. 61/690,818, filed on Jul. 5, 2012.

(51) Int. Cl.

| | |
|---|---|
| ***E04H 4/16*** | (2006.01) |
| ***E04H 4/14*** | (2006.01) |
| *E04H 4/12* | (2006.01) |

(52) U.S. Cl.

CPC ..... *E04H 4/16* (2013.01); *E04H 4/1281* (2013.01); *E04H 4/14* (2013.01)

(58) Field of Classification Search

CPC ..... E04H 4/16; E04H 4/1609; E04H 4/1618; E04H 4/1263; E04H 4/1272

USPC ..... 294/99.1, 3, 16, 24, 26, 99.2, 97, 195; 210/237, 238, 465, 470

See application file for complete search history.

(56) References Cited

U.S. PATENT DOCUMENTS

| | | | | |
|---|---|---|---|---|
| 541,842 | A * | 7/1895 | Finley | 7/158 |
| 1,493,362 | A | 5/1924 | Martelli | |
| 1,879,161 | A * | 9/1932 | Frambach et al. | 43/53.5 |
| 2,526,085 | A | 8/1947 | Rotollo | |
| 2,776,667 | A * | 1/1957 | Fitz Gerald | 132/224 |
| 4,389,912 | A * | 6/1983 | Dallons et al. | 294/99.2 |
| 4,592,676 | A * | 6/1986 | Gilgen | 405/36 |
| D321,055 | S | 10/1991 | Carchidi | |
| 5,793,018 | A * | 8/1998 | Jett | 219/225 |
| 5,830,350 | A * | 11/1998 | Voss et al. | 210/167.12 |
| 6,422,623 | B1 | 7/2002 | Thomas | |
| 7,065,883 | B2 | 6/2006 | Popeil et al. | |
| 7,309,088 | B2 | 12/2007 | Fiore et al. | |
| 2001/0015561 | A1 * | 8/2001 | Tseng | 294/16 |
| 2004/0045895 | A1 * | 3/2004 | Bonelli et al. | 210/497.1 |
| 2004/0104586 | A1 * | 6/2004 | Rose | 294/16 |
| 2014/0327257 | A1 * | 11/2014 | Vazquez | 294/24 |

OTHER PUBLICATIONS

MSECompany.net; 5.5in Spread Gelpi Reactor, (May 2012).
DIYTrade.com; Post Hole digger, (May 2012).

* cited by examiner

*Primary Examiner* — Paul T Chin

(57) ABSTRACT

A multipurpose tool and method usable to remove debris and/or other retentate from a skimmer basket or a filter associated with a swimming pool, and/or to remove the skimmer well lid and the skimmer basket and/or filter from a skimmer well. The tool comprises two elongate members pivotally connected, each elongate member having a protrusion connected thereto at one end and a handle at the other. Each elongate member can have a scooping element connected thereto. The protrusions can point away from each other and can be adapted to move away from each other in response to the handles being moved towards each other.

14 Claims, 4 Drawing Sheets

APPARATUS AND METHOD FOR LIFTING A SKIMMER WELL LID AND FOR CLEANING AND LIFTING A SKIMMER BASKET

CROSS-REFERENCE TO RELATED APPLICATIONS

The present application is a non-provisional application claiming priority to the U.S. provisional patent application having the Ser. No. 61/690,818, entitled "Apparatus and Method for Lifting Skimmer Well Lid and for Cleaning and Lifting Skimmer Basket," filed on Jul. 5, 2012, the entirety of which is incorporated by reference herein.

FIELD

Embodiments usable within the scope of the present disclosure relate, generally, to devices and methods usable in the field of swimming pool maintenance and, more particularly, to a multipurpose tool usable to remove debris and/or other retentate from a skimmer basket or a filter associated with a swimming pool, and/or to remove the skimmer well lid and the skimmer basket and/or filter from a skimmer well.

BACKGROUND

Removing floating debris from a swimming pool is a continuously necessary maintenance task. To accomplish removal of such debris, water is typically drawn from the pool via an aperture in the wall of the pool and into a filtration device called a skimmer, which traps debris that is removed from the pool in this manner. Contained in the skimmer is a basket that filters the water carrying the debris, thus trapping the debris and preventing the debris from passing through to a pump in communication with the swimming pool for water circulation. As the skimmer basket accumulates debris, it eventually becomes clogged. Thus, cleaning of the skimmer basket is a necessary and regular task for maintaining proper swimming pool water circulation and clarity.

Most skimmers include a lid or cover, which is normally mounted flush or slightly raised with respect to the pool deck to avoid creating a tripping hazard. As a result, a skimmer lid or cover is usually difficult to remove. A lid may include a hole at its center or a plurality of holes located off center, closer to the edges of the lid. The removal of the lid may require a person to insert their fingers through the holes to grab the lid. Once the lid is removed to expose the underlying basket, removal and cleaning of the basket is often an unpleasant and possibly a dangerous task, due to the various types of biological debris and insects/reptiles that can fall into a pool and eventually be swept into the skimmer basket. In addition, most skimmer baskets include some type of a handle, which can be used to lift the basket from within the skimmer well. Quite often, however, such basket handles can break off, creating difficulties when attempting to lift the basket. In addition, even when the handle is intact, a user is still required to bend over, reach into the water and/or debris, through the undesirable contents of the basket, to manually grab the handle of the basket.

Devices have been designed to assist with the abovementioned maintenance tasks, the majority of which include tools having a single rod and/or a single hook used to engage and lift portions of a skimmer. However, these devices do not provide an effective means for removing a skimmer well lid, in addition to lacking an effective means for removing the skimmer basket from the skimmer well and/or removing debris from the basket.

Due to the fact that many skimmer well lids have unlatching or removal openings/holes positioned at the sides or off-center of the lid, rather than at the center thereof, a conventional tool created for such a purpose (e.g., a tool having a single hook) is not adequate for removing a skimmer well lid. Further, such a tool does not distribute the lifting force equally throughout the lid, which tends to lead to the breaking of the lid and/or the basket, as well as an ineffective lifting of the lid and/or basket. For example, as the lid is lifted on one side by such a tool, it is pulled unevenly and may become jammed against the sides of the skimmer well. If this happens, a user must then bend down to manually unlock the lid to uncover the skimmer well. A need therefore exists for a tool that will effectively remove a skimmer well lid without jamming or otherwise causing the lid to become stuck or broken and will allow for the lifting and/or replacing of the lid, without requiring the insertion of fingers through the lid, thus providing a safer manner to lift and/or replace the lid.

Some conventional tools (e.g., tools having a single hook) may be used to remove a skimmer basket by its handle. However, a single hook focusses all forces, and the weight of the basket, on the middle of the handle, which can cause the handle and/or basket to break. In situations where the skimmer basket does not include a central handle, or if the handle has broken, the basket must be lifted by gripping the sidewalls thereof. In such cases, a tool having a single hook is not adequate, as such, a tool can only engage the basket on a single side. Such tools do not equally distribute the lifting force on the basket and typically cause the basket to turn sideways, spilling its contents down the skimmer well and into the water pump, which creates potential source of damage to the pump. Further, when this occurs, the user will have to bend down and manually clean the basket, forcing the user to be exposed to potentially undesirable contents. Therefore, a need exists for a tool that can effectively grip and lift a skimmer basket without breaking the basket or allowing it to turn sideways upon lifting. A need exists for a tool that will evenly distribute the lifting forces and weight of the basket about at least two or more points along the rim of the basket.

In other situations, a skimmer basket may become overfilled with debris, and a user will be unable to locate the handle or the rim of the basket. Conventional tools are not usable to grasp and lift debris from the skimmer basket, as the debris is located within the skimmer well. In such situations, a user must bend over and manually clean at least a portion of the debris from the basket before being able to remove the basket from the skimmer well, to complete the cleaning operation. A further need exists for a tool that can be used to remove debris from the skimmer basket while it is located within the skimmer well, without requiring a user to manually reach a hand into the skimmer well to clean or remove at least a portion of the debris from the basket.

BRIEF DESCRIPTION OF THE DRAWINGS

In the detailed description of various embodiments usable within the scope of the present disclosure, presented below, reference is made to the accompanying drawings, in which.

DETAILED DESCRIPTION

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Embodiments usable within the scope of the present disclosure relate to systems and methods usable in the field of swimming pool maintenance. The disclosed embodiments further relate to devices and methods usable to remove a skimmer well lid or cover, remove debris and/or other retentate from a skimmer basket or a filter (e.g., while the skimmer basket remains in the skimmer well, or after removal therefrom), and to remove the skimmer basket from within the skimmer well. Each of such tasks can be performed while a user remains generally upright or requiring the user to bend over less, and can further be performed without requiring that the user directly touch any debris or other contents of the skimmer basket, or any part of the skimmer apparatus.

Figure 1:
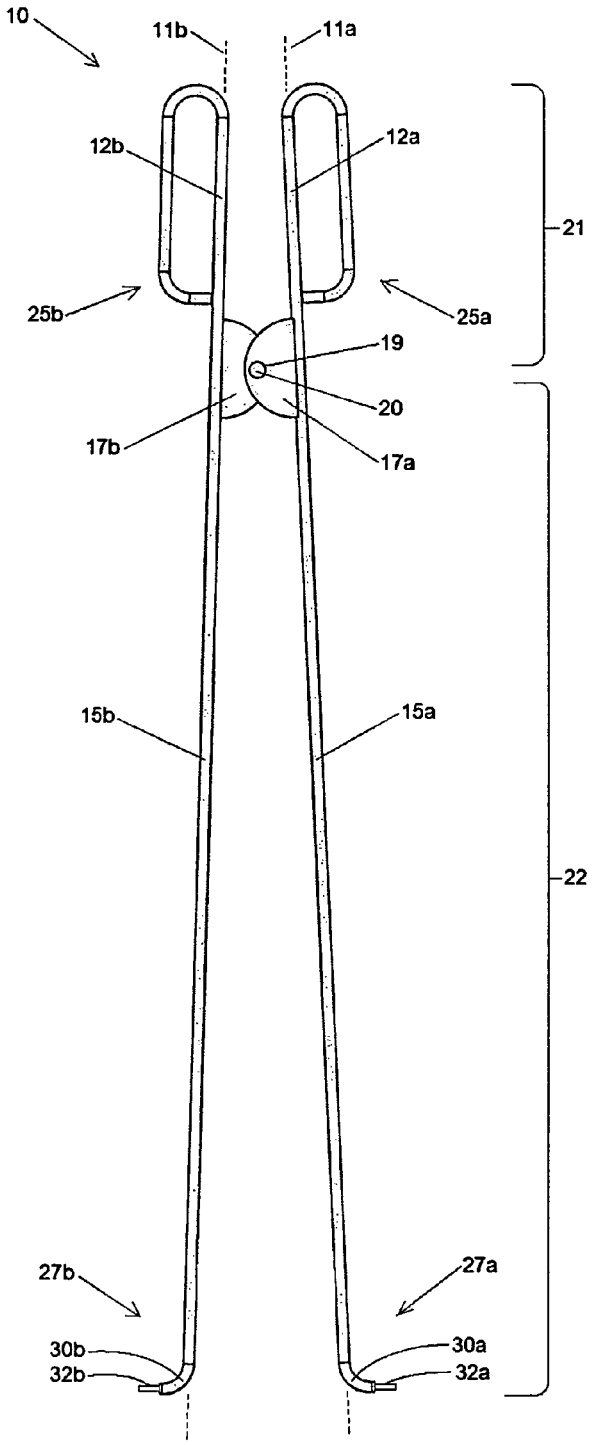
FIG. 1 depicts a side view of an embodiment of the tool usable within the scope of the present disclosure.
Figure 3:
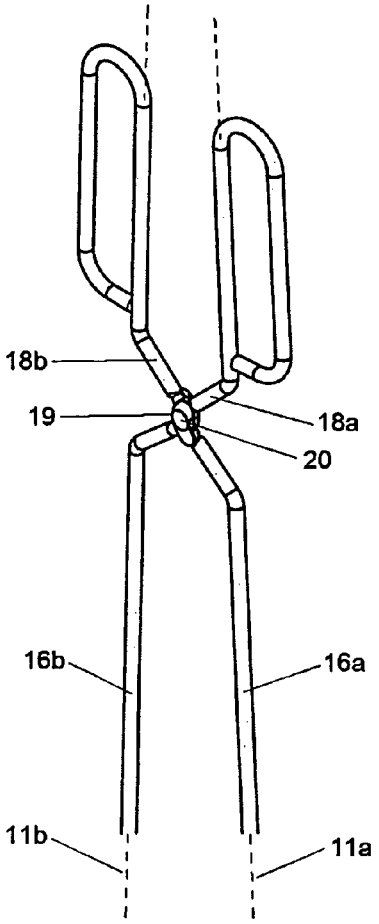
FIG. 3 depicts an isometric view of another embodiment of the tool usable within the scope of the present disclosure.

Referring now to FIG. 1, a side view of an embodiment of a tool (10) usable within the scope of the present disclosure is shown. The depicted tool includes a pair of elongate rods or arms (15*a*, 15*b*), each having a longitudinal axis (11*a*, 11*b*). The elongate rods or arms (15*a*, 15*b*) comprise a first ends (27*a*, 27*b*) and a second ends (25*a*, 25*b*), wherein the arms (15*a*, 15*b*) are pivotally joined together at a fulcrum (20), which is positioned closer to the second ends (25*a*, 25*b*) of the arms (15*a*, 15*b*). Each elongate arm (15*a*, 15*b*) comprises a grip member, depicted as handles (12*a*, 12*b*) with finger guards, positioned at the second end (25*a*, 25*b*) of each arm (15*a*, 15*b*). Each elongate arm (15*a*, 15*b*) further comprises a lateral protrusion, depicted as a lateral prong (30*a*, 30*b*), positioned at the first ends (27*a*, 27*b*) thereof. To connect the arms (15*a*, 15*b*) together, each of the two arms (15*a*, 15*b*) is shown having a generally flat protruding surface (17*a*, 17*b*) extending laterally therefrom, each of the surfaces (17*a*, 17*b*) contains an aperture, through which a screw, pin (19), or similar fastener can be positioned to form a pivot point (20) between the arms (15*a*, 15*b*). Although the protruding surfaces (17*a*, 17*b*) are depicted as having a generally oval, elliptical, and/or semi-circular shape, embodiments usable within the scope of the disclosure can include any shape, including circular, elliptical, or triangular. In another embodiment, the arms (15*a*, 15*b*) can be pivotally engaged by other manners without departing from the scope of the present disclosure. In yet another embodiment of the tool (10), depicted in FIG. 3, the arms (16*a*, 16*b*) comprise a plurality of bends to form lateral extensions (18*a*, 18*b*) from the longitudinal axes (11*a*, 11*b*) of the arms (16*a*, 16*b*), wherein a central bend comprises an aperture through which a pin (19) may be inserted to form a pivot point (20) between the arms (16*a*, 16*b*). As further depicted in FIG. 3, a section of the arms (16*a*, 16*b*), adjacent to the pivot point (20), may be flat to improve the stability and the pivoting action between the arms (16*a*, 16*b*).

Referring again to the embodiment of the tool (10) depicted in FIG. 1, in the course of operating the tool (10), as shown, the arms (15*a*, 15*b*) do not cross or intersect, such that when the handles (12*a*, 12*b*) are moved closer together or farther apart, the lateral prongs (30*a*, 30*b*) move in opposite directions. For example, when the handles (12*a*, 12*b*) are moved closer to one another, the pivot point (20) between the arms (15*a*, 15*b*) enables the lateral prongs (30*a*, 30*b*) to spread apart. In another embodiment of the tool (10) (not shown), each arm of the tool may intersect and extend on the opposite side of the other arm, when pivotally joined together at a fulcrum by a pivot pin. Such configuration enables the handles to move in the same direction as the lateral prongs, whereby moving the second ends farther apart from one another would cause the opposing first set of ends to also move farther apart.

Referring again to FIG. 1, the tool (10) is depicted having the arms (15*a*, 15*b*) divided into two portions by the position of the fulcrum (20): a shorter region (21) (e.g., a handle region), and a longer region (22) (e.g., a functional region). The ratio between the length of the functional region (22) and the length of the handle region (21) can range from 2:1 to 5:1. The handles (12*a*, 12*b*) can comprise any form of grip assisting elements attached to the arms or integrally formed with the arms. For example, the handles (12*a*, 12*b*) may comprise non-slip surfaces, finger guards, thimbles, or eye rings, which can assist in the manual contraction and/or expansion (e.g., by a user) of the handles (12*a*, 12*b*). The handles (12*a*, 12*b*) can extend a partial length or a full length of the handle region (21). During typical operation, the handles (12*a*, 12*b*) can be gripped by a user to move them apart or to bring them together to force the prongs (30*a*, 30*b*) to move apart or to come together.

In the embodiment depicted in FIG. 1, the first ends (27*a*, 27*b*) of each arm (15*a*, 15*b*) comprises a protruding element or a prong (30*a*, 30*b*) extending laterally away from each other. The lateral prongs (30*a*, 30*b*) can be separate components that are attached to the arms (15*a*, 15*b*) (e.g. by welding) or integrally formed as part of the arms (15*a*, 15*b*) (e.g., by bending the first ends of each arm). For example, the first ends (27*a*, 27*b*) of the arms (15*a*, 15*b*) can be bent away from each other or otherwise aligned to point away from one another to form the prongs (30*a*, 30*b*). In the depicted embodiment of FIG. 1, the first ends (27*a*, 27*b*) of the arms (15*a*, 15*b*) are bent about 90 degrees to form the prongs (30*a*, 30*b*); however, in alternate embodiments (not shown), the prongs can be bent to form an angle ranging from approximately 70 to 100 degrees or attached to the arms (15*a*, 15*b*) at an angle ranging from approximately 70 to 100 degrees. To enable or improve insertion of the prongs (30*a*, 30*b*) into the surface or the mesh of a filter or skimmer basket (not shown), each prong may comprise a narrow tip (32*a*, 32*b*). In an alternate embodiment depicted in FIG. 2, the prongs (30*a*, 30*b* not shown) may be tapered to a point (33*a*, 33*b* not shown), enabling the prong to be at least partially inserted into the wall or the mesh of a filter or a skimmer basket. The prongs (30*a*, 30*b*), the tips (32*a*, 32*b*), the points (33*a*, 33*b*), or combinations thereof, can range from 0.25 inches to two or more inches in length.

Embodiments of the tool (10) can incorporate additional members and/or instruments that improve the function thereof. In an embodiment of the tool (10), depicted in FIG. 2, each arm (15*a*, 15*b*) may include a grasping member or a scoop (34*a*, 34*b*) connected thereto adjacent to the first end (27*a*, 27*b*) of each arm. The scoops (34*a*, 34*b*), can be separate components attached to the arms (15*a*, 15*b*), or integrally formed with the arms. In the depicted embodiment of FIG. 2, the scoops are shown comprising a generally curved triangular surface connected to the arms (15*a*, 15*b*) and facing each other. In an alternate embodiment (not shown), the scoops may comprise generally flat triangular surfaces, which face each other.

Figure 4:
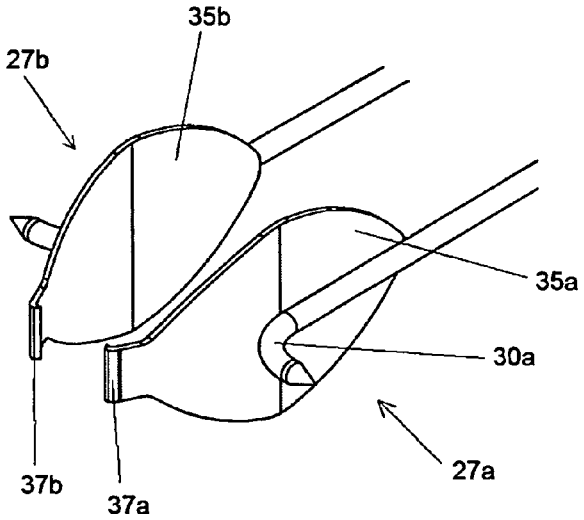
FIG. 4 depicts a close-up isometric view of another embodiment of the tool usable within the scope of the present disclosure.

In the embodiment depicted of the tool (10) depicted in FIG. 4, the scoops (35*a*, 35*b*) comprise curved oval-shaped surfaces that extend past the prongs (30*a*, 30*b* not shown). The scoops can be used to grasp debris from the skimmer basket (46, see FIG. 8) before the skimmer basket is lifted from the skimmer well (42, see FIG. 8), or after the removal of the skimmer basket from the skimmer well (42, see FIG. 8). Therefore, any scoop having a general size and shape adapted to compress and grasp debris from the skimmer basket, is within the scope of the present disclosure. Furthermore, the scoops (35*a*, 35*b*) depicted in FIG. 4 are shown having lateral surfaces or grippers (37*a*, 37*b*) protruding from the bottom sides thereof. In this embodiment, the grippers (37*a*, 37*b*) are depicted as rectangular, generally flat protrusions extending from the bottoms of the generally oval-shaped scoops (35*a*, 35*b*). In the depicted embodiment, the grippers (37*a*, 37*b*) are shown extending from the scoops (35*a*, 35*b*) in a generally perpendicular direction; however, in other embodiments, the grippers (37*a*, 37*b*) may extend relative to the scoops (35*a*, 35*b*) at any angle ranging from 30 degrees to 90 degrees, or any other angle capable of engaging the lid (48, see FIG. 7) of a skimmer well (42, see FIG. 7). Although FIG. 4 depicts oval-shaped scoops (35*a*, 35*b*) and rectangular grippers (37*a*, 37*b*), it should be understood that these components can include any shape and/or dimensions able to accommodate the shape and/or features of a skimmer basket or skimmer well lid, such as the opening or hole spacing, size, and/or shape thereof. In an embodiment, each gripper (37*a*, 37*b*) can extend from 0.25 to 0.75 inches from the respective scoop.

Figure 5:
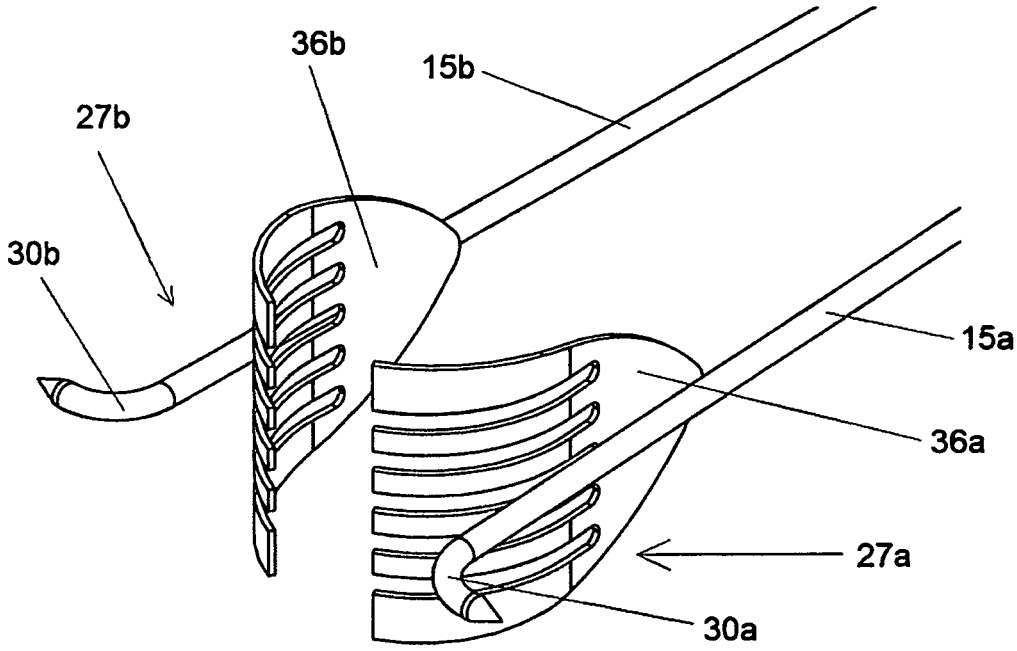
FIG. 5 depicts a close-up isometric view of another embodiment of the tool usable within the scope of the present disclosure.

Referring now to FIG. 5, depicting another embodiment of the tool (10) within the scope of the present disclosure. In the depicted embodiment, each arm (15*a*, 15*b*) of the tool (10) comprises a rake (36*a*, 36*b*) having a plurality of inwardly curved prongs. In other embodiments, however, the rake can include any shape, dimensions, or comprise any number of prongs, and be attached at any position near the first end (27*a*, 27*b*) of each arm (15*a*, 15*b*) without departing from the scope of the current disclosure. The rakes (36*a*, 36*b*) can extend from the arms (15*a*, 15*b*) at any angle that is able to engage a skimmer well lid (48, see FIG. 7) and/or debris within a skimmer basket (46, see FIG. 9).

Figure 6:
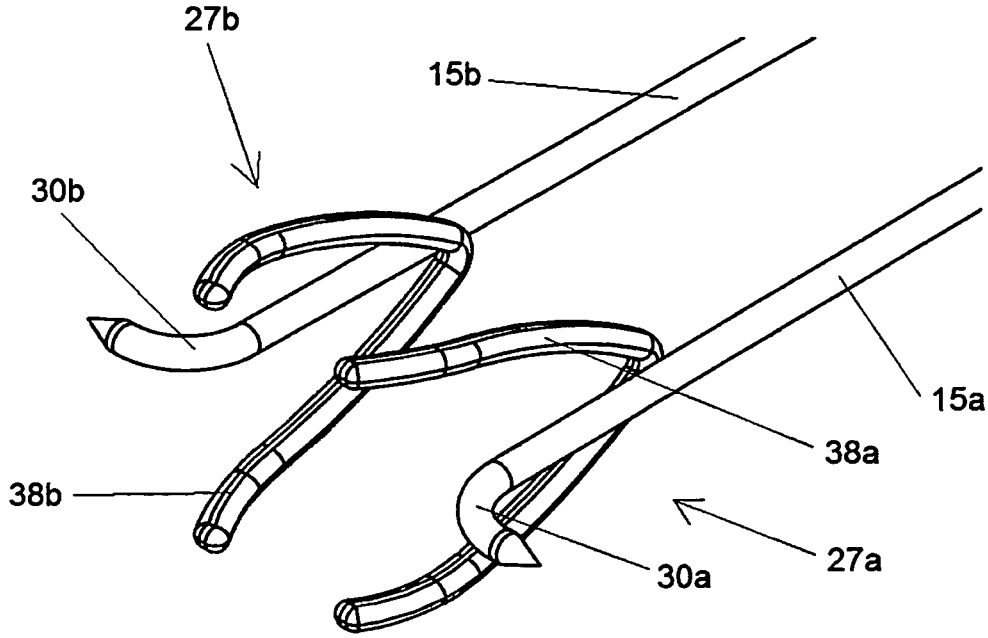
FIG. 6 depicts a close-up isometric view of another embodiment of the tool usable within the scope of the present disclosure.

Referring now to FIG. 6, depicting another embodiment of the tool (10) within the scope of the present disclosure. In the depicted embodiment, each arm (15*a*, 15*b*) of the tool (10) has a plurality of fingers (38*a*, 38*b*) attached thereto, each finger is depicted as a generally elongate, round (e.g., cylindrical) spine extending past the prongs (30*a*, 30*b*). In other embodiments, however, the fingers can include any shape, dimensions, or be incorporated in any numbers near the first end (27*a*, 27*b*) of each arm (15*a*, 15*b*) without departing from the scope of the current disclosure. The fingers (38*a*, 38*b*) can extend from the arms (15*a*, 15*b*) at any angle that is able to engage a skimmer well lid (48, see FIG. 7) and/or debris within a skimmer basket (46, see FIG. 9).

Although the embodiments of the tool (10), depicted in FIGS. 1-6 are constructed of generally thin steel rods, any material having sufficient structural rigidity can be used, including other metals, such as aluminum, or plastics. Furthermore, the tool (10) may be formed from several separate components that are attached, fastened, or welded together, or manufactured as an integral unit (e.g., via molding). The overall size and length of the tool (10) can vary, depending on the desired requirements. For example, skimmer wells may vary in depth, and skimmer baskets may vary in width/diameter, such that a tool (10), having a different length or other dimensions, can be more suitable for use with certain skimmers. Thus, while the depicted embodiments of the tool (10) comprise an overall length of about 24 inches, embodiments usable within the scope of the present disclosure can range in overall length as needed.

In operation, embodiments described herein include a multipurpose tool usable in the maintenance of a pool skimmer. Specifically, the tool may be used to aid in the removal of a pool skimmer lid, the removal of debris from within the skimmer basket, and the removal of the skimmer basket from the skimmer well, independent of whether the skimmer basket has a handle attached thereto.

Figure 2:
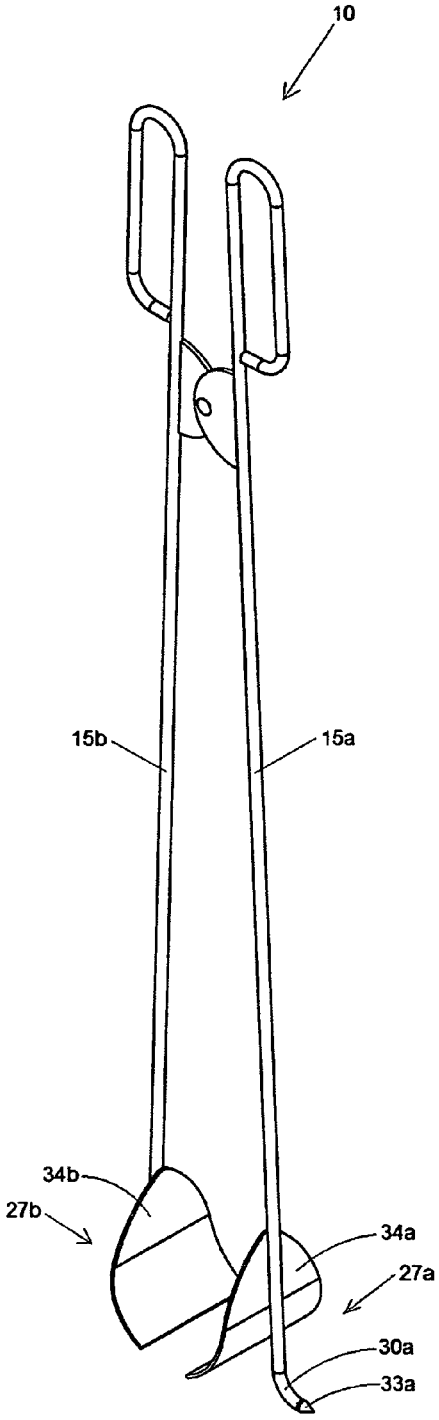
FIG. 2 depicts an isometric view of another embodiment of the tool usable within the scope of the present disclosure.
Figure 7:
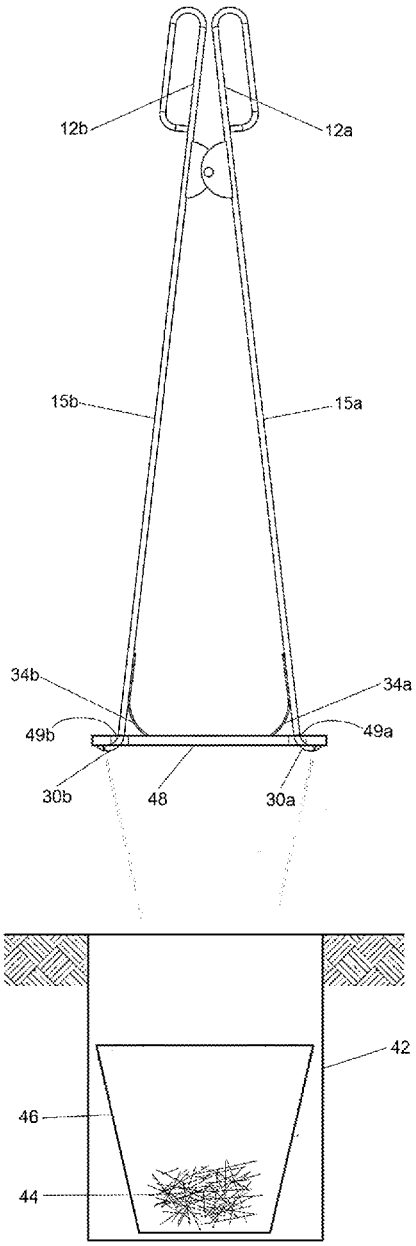
FIG. 7 depicts a step in an embodiment of the present invention usable to remove a skimmer basket cover from a skimmer well.

An embodiment of the tool (10), depicted in FIG. 2, can be used to remove a lid or cover (48) from a skimmer well (42, see FIG. 7). First, the tool is manually positioned over the skimmer well lid (48) by a user so that the prongs (30*a*, 30*b*) are aligned over the holes (49*a*, 49*b*) in the lid. The points (33*a*, 33*b*) are then inserted into the holes (49*a*, 49*b*), the handles (12*a*, 12*b*) are moved toward one another, which cause expansion of the prongs (30*a*, 30*b*) to engage the prongs (30*a*, 30*b*) and/or the points (33*a*, 33*b*) with the holes (49*a*, 49*b*). The tool (10) can then be lifted upwards, thereby lifting the engaged lid (48). Unlike conventional tools, such as those having a single hook, the two prongs (30*a*, 30*b*) provide an equal distribution of lifting force on the lid (48), preventing the lid (48) from wedging or jamming against the sides of the skimmer well (42), or otherwise applying an undesirable force to the user and/or the tool (10).

In an alternate embodiment of the above process, the tools (10) depicted in FIGS. 4, 5, and 6 may be used to remove the lid (48) from a skimmer well. The rectangular grippers (37*a*, 37*b*) depicted in FIG. 4, the rakes (36*a*, 36*b*) depicted in FIG. 5, or the fingers (38*a*, 38*b*) depicted in FIG. 6, may be manually positioned over the skimmer well lid (48), aligned over the holes (49*a*, 49*b*) in the lid (48), and inserted into the holes (49*a*, 49*b*). The handles (12*a*, 12*b*, see FIG. 2) may then be manually moved apart, causing the grippers (37*a*, 37*b*), the rakes (36*a*, 36*b*), or the fingers (38*a*, 38*b*) to move towards each other and engage the holes (49*a*, 49*b*). The tool (10) may then be lifted, thereby lifting the engaged lid (48) and moving it to a desired location.

Figure 8:
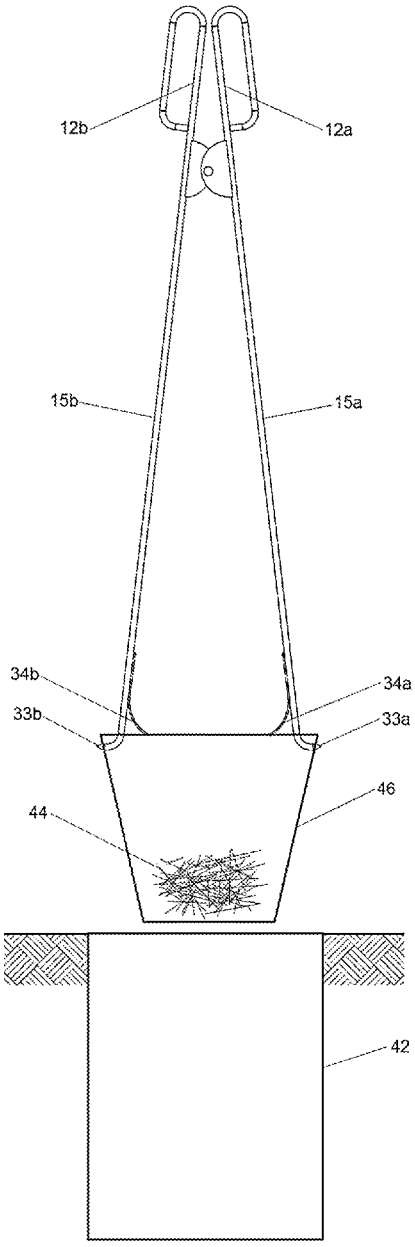
FIG. 8 depicts a step in an embodiment of the present invention usable to remove the skimmer basket from the skimmer well.
Figure 9:
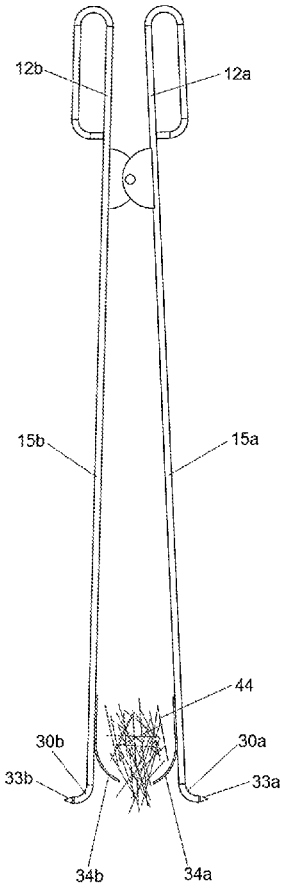
FIG. 9 depicts a step in an embodiment of the present invention usable to remove debris from the skimmer basket.

Turning now to FIG. 9, depicting a step of using the tool (10) to clean out the skimmer basket (46, see FIG. 8) when debris (44) has accumulated therein prior to lifting the skimmer basket (46) from the skimmer well (42). The tool (10) depicted in FIG. 2 is first inserted into the well (42, see FIG. 7), with the scoops (34*a*, 34*b*) of the tool (10) spread apart (e.g., by moving the handles (12*a*, 12*b*) toward one another) around the debris (44) located in the skimmer basket (46, see FIG. 8). The handles (12*a*, 12*b*) are then moved apart from one another such that the elongate arms (15*a*, 15*b*) and the scoops (34*a*, 34*b*) close about at least a portion of the debris (44). The debris (44) can then be grasped and pulled from the basket and/or the well (42) by lifting the tool (10), as depicted in FIG. 9.

FIG. 8 depicts a step of using the tool (10) of FIG. 2, to remove the skimmer basket (46) from the skimmer well (42). First, the arms (15*a*, 15*b*) of the tool (10) are inserted into the basket (46) such that the prongs (30*a*, 30*b*) are positioned below the top rim or edge of the basket (46). The handles (12*a*, 12*b* not shown) are then manipulated (e.g., moved toward one another) to expand the prongs (30*a*, 30*b*) outward into the sides or walls of the basket (46), such that the points (33*a*, 33*b*) are inserted or embedded into the walls (e.g. the mesh) of the basket (46) or under the rim of the basket (46). Once the points (33*a*, 33*b*) (or alternatively the tips (32a, 32b) depicted in FIG. 1) are inserted into the walls of the basket (46) or are abutting the rim of the basket (46), the tool (10) can be lifted, along with the basket (46), from the skimmer well (42), as shown in FIG. 8. After the skimmer basket (46) is removed from the skimmer well (42), the debris (44) can be removed from the basket (46) using the scoops (34*a*, 34*b*), using the method described above. Upon removal of the debris (44) from the skimmer basket (46), the tool (10) can be used to grip the basket (46), as described above, and lower it back into the well (42).

It should be understood that the steps described above, partially illustrated in FIGS. 7-9 are merely exemplary, and can vary depending on the specific tool used and/or the particular skimmer assembly engaged. While certain embodiments of the present invention have been illustrated and described herein, the present invention should not be limited to such illustrations and descriptions. It should be apparent to those skilled in the art that changes and modifications may be incorporated and embodied as part of the present invention and are within the scope of the claims.

What is claimed is:

1. An apparatus usable for lifting and cleaning a skimmer basket, wherein the apparatus comprises:

a first elongate member having a first end and a second end, wherein a first protrusion extends laterally from the first end of the first elongate member, wherein a first scooping element is connected to the first elongate member adjacent to the first protrusion, and wherein a first hand grip region is connected to the second end of the first elongate member; and a second elongate member having a first end and a second end, wherein a second protrusion extends laterally from the first end of the second elongate member, wherein a second scooping element is connected to the second elongate member adjacent to the second protrusion, and wherein a second hand grip region is connected to the second end of the second elongate member, wherein the first and the second elongate members are pivotally connected, wherein the pivotal connection is located closer to the second end of each elongated member than to the first end of each elongated member, wherein the protrusions are shaped to extend away from each other, and wherein the protrusions are adapted to move away from each other in response to the handgrip regions being moved towards each other.

2. The apparatus of claim 1, wherein the grip region comprises a non-slip surface, a finger guard, a thimble, an eye ring, a handle, or combinations thereof.

3. The apparatus of claim 1, wherein the protrusions comprise a tapered region or a smaller thickness than the elongate members.

4. The apparatus of claim 1, wherein the protrusions comprise a pointed tip.

5. The apparatus of claim 1, wherein the scooping elements comprise a flat plate, a concave plate, a plurality of prongs, or combinations thereof.

6. The apparatus of claim 1, wherein the handgrip regions are adapted to move towards each other thereby causing the protrusions to move away from each other and to extend into an inside surface of a container, to connect to points along a wall or a perimeter of the container, or combinations thereof.

7. The apparatus of claim 1, wherein the elongate members comprise a generally straight configuration.

8. The apparatus of claim 1, wherein the elongate members comprise a length of twelve inches or greater.

9. The apparatus of claim 1, wherein the scooping elements are positioned between the first and the second elongate members.

10. The apparatus of claim 1, wherein the protrusions extend from the elongate members at an angle of approximately ninety degrees.

11. A method of moving and cleaning a pool skimmer basket, comprising the steps of:

inserting a tool into a skimmer well;

inserting the tool into a skimmer basket;

manually moving grip portions of the tool toward each other thereby moving protrusions of the tool away from each other;

engaging the protrusions with an inside wall of the skimmer basket thereby connecting the tool to the skimmer basket;

moving the tool out of the skimmer well thereby pulling the skimmer basket out of the skimmer well;

moving grip portions of the tool away from each other, thereby moving scooping members of the tool towards each other;

compressing contents of the skimmer basket between scooping members of the tool; and moving the scooping members out of the skimmer basket thereby moving the contents of the skimmer basket out of the skimmer basket.

12. The method of claim 11, wherein the step of inserting a tool into a skimmer well is preceded by removing a skimmer cover by gripping the skimmer cover with the tool and pulling the skimmer cover away from the skimmer housing.

13. The method of claim 11, wherein the step of engaging the protrusions with an inside wall of the skimmer basket comprises extending the protrusions through at least two openings in the wall of the skimmer basket, extending the protrusions into at least two indentations along the wall, extending the protrusions against the surface of the inside wall, or combinations thereof.

14. The method of claim 11, wherein the step of engaging the protrusions with an inside wall of the skimmer basket comprises using the tool to contact at least two points along a rim of the skimmer basket, below the rim of the skimmer basket, or along a perimeter of the wall of the skimmer basket.

* * * * *